US012419436B2

(12) United States Patent
Karschnik

(10) Patent No.: US 12,419,436 B2
(45) Date of Patent: Sep. 23, 2025

(54) MULTI-AIR CHAMBER MATTRESS WITH LOCALIZED SUPPORT

(71) Applicant: Sleep Number Corporation, Minneapolis, MN (US)

(72) Inventor: Kody Lee Karschnik, Plymouth, MN (US)

(73) Assignee: Sleep Number Corporation, Minneapolis, MN (US)

( * ) Notice: Subject to any disclaimer, the term of this patent is extended or adjusted under 35 U.S.C. 154(b) by 257 days.

(21) Appl. No.: 17/862,817

(22) Filed: Jul. 12, 2022

(65) Prior Publication Data

US 2023/0027288 A1 Jan. 26, 2023

Related U.S. Application Data

(60) Provisional application No. 63/223,253, filed on Jul. 19, 2021.

(51) Int. Cl.
*A47C 27/10* (2006.01)
*A47C 27/08* (2006.01)

(52) U.S. Cl.
CPC ..... *A47C 27/10* (2013.01); *A47C 27/082* (2013.01)

(58) Field of Classification Search
CPC ..... A47C 27/08; A47C 27/081; A47C 27/082; A47C 27/083; A47C 27/084; A47C 27/085; A47C 27/087; A47C 27/088; A47C 27/10; A47C 27/14; A47C 27/144; A47C 27/15; A47C 27/18
See application file for complete search history.

(56) References Cited

U.S. PATENT DOCUMENTS 4,193,149 A * 3/1980 Welch ..... A61G 7/05776 5/713
4,644,597 A 2/1987 Walker
4,766,628 A 8/1988 Walker
(Continued)

FOREIGN PATENT DOCUMENTS

| | | |
|---|---|---|
| DE | 2424440 | 12/1974 |
| FR | 2743995 | 8/1997 |
| FR | 2814653 | 4/2002 |

OTHER PUBLICATIONS

U.S. Appl. No. 09/471,592, filed Dec. 23, 1999, Shafer.
(Continued)

*Primary Examiner* — George Sun
(74) *Attorney, Agent, or Firm* — Fish & Richardson P.C.

(57) ABSTRACT

Described herein are mattresses with localized air chamber support. A mattress can include a first air chamber positioned at a shoulder region, a second air chamber positioned at a hip region and fluidly connected to the first air chamber, and a foam insert positioned between the air chambers. The air chambers can share a common internal pressure. Decreasing the common internal pressure in the air chambers can cause the foam insert to increase support at a lumbar region of the mattress. Additional foam inserts can be positioned between at least one of the first air chamber and a head end of the mattress, the first and second air chambers, and the second air chamber and a foot end of the mattress. The mattress can also include a foam rail structure that extends around a perimeter of the mattress to surround the components therein.

23 Claims, 8 Drawing Sheets

(56) References Cited

U.S. PATENT DOCUMENTS 4,788,729 A 12/1988 Walker
D300,194 S 3/1989 Walker
4,829,616 A 5/1989 Walker
4,890,344 A 1/1990 Walker
4,897,890 A 2/1990 Walker
4,908,895 A 3/1990 Walker
D313,973 S 1/1991 Walker
4,991,244 A 2/1991 Walker
5,105,488 A * 4/1992 Hutchinson ..... A47C 27/064 5/652
5,144,706 A 9/1992 Walker
5,170,522 A 12/1992 Walker
5,231,717 A * 8/1993 Scott ..... A47C 31/123 5/400
5,282,286 A * 2/1994 MacLeish ..... A61G 5/1045 5/655.3
5,421,044 A * 6/1995 Steensen ..... A47C 27/18 5/713
D368,475 S 4/1996 Scott
5,509,154 A 4/1996 Shafer et al.
5,564,140 A 10/1996 Shoenhair et al.
5,642,546 A 7/1997 Shoenhair
5,652,484 A 7/1997 Shafer et al.
5,666,681 A * 9/1997 Meyer ..... A61G 7/05769 5/624
5,765,246 A 6/1998 Shoenhair
5,829,081 A * 11/1998 Pearce ..... A61G 5/1045 5/654
5,903,941 A 5/1999 Shafer et al.
5,904,172 A 5/1999 Gifft et al.
6,037,723 A 3/2000 Shafer et al.
6,085,372 A * 7/2000 James ..... A61G 7/05784 5/713
6,108,844 A 8/2000 Kraft et al.
6,161,231 A 12/2000 Kraft et al.
6,202,239 B1 * 3/2001 Ward ..... A47C 27/082 5/724
6,397,419 B1 6/2002 Mechache
6,483,264 B1 11/2002 Shafer et al.
6,686,711 B2 2/2004 Rose et al.
6,708,357 B2 3/2004 Gaboury et al.
6,763,541 B2 7/2004 Mahoney et al.
6,804,848 B1 * 10/2004 Rose ..... A47C 27/18 5/710
6,832,397 B2 12/2004 Gaboury et al.
D502,929 S 3/2005 Copeland et al.
6,883,191 B2 4/2005 Gaboury et al.
7,036,172 B2 * 5/2006 Torbet ..... A47C 27/082 5/736
7,389,554 B1 6/2008 Rose
7,849,544 B2 * 12/2010 Flocard ..... A61G 7/05769 5/713
7,865,988 B2 1/2011 Koughan et al.
8,336,369 B2 12/2012 Mahoney
D691,118 S 10/2013 Ingham et al.
D697,874 S 1/2014 Stusynski et al.
D698,338 S 1/2014 Ingham et al.
D701,536 S 3/2014 Shakal et al.
8,769,747 B2 7/2014 Mahoney et al.
8,893,339 B2 11/2014 Fleury et al.
8,931,329 B2 1/2015 Mahoney et al.
8,966,689 B2 3/2015 McGuire et al.
8,973,183 B1 3/2015 Palashewski et al.
D728,254 S 5/2015 Blazar et al.
9,078,795 B1 * 7/2015 Wilkinson ..... A61G 7/05776
D737,250 S 8/2015 Ingham et al.
9,314,118 B2 4/2016 Blazar et al.
9,578,941 B2 2/2017 MacLachlan et al.
9,730,524 B2 8/2017 Chen et al.
9,737,154 B2 8/2017 Mahoney et al.
D809,843 S 2/2018 Keeley et al.
D812,393 S 3/2018 Karschnik et al.
9,924,813 B1 3/2018 Basten et al.
10,143,312 B2 12/2018 Brosnan et al.
D840,732 S 2/2019 Peterson et al.
10,194,753 B2 2/2019 Fleury et al.
10,285,508 B2 5/2019 Rose et al.
D857,433 S 8/2019 Kiekhoefer et al.
10,531,745 B2 1/2020 McGuire et al.
10,539,170 B2 1/2020 Peterson et al.
10,575,654 B2 3/2020 Shakal
10,677,232 B2 6/2020 Shakal et al.
10,729,253 B1 8/2020 Gaunt
10,765,224 B2 9/2020 Chen et al.
10,813,470 B2 10/2020 Mahoney et al.
10,888,173 B2 1/2021 Shakal et al.
10,993,546 B2 5/2021 Shakal et al.
11,001,447 B2 5/2021 Shutes et al.
11,085,479 B2 8/2021 Griffith et al.
11,096,502 B2 8/2021 Rose et al.
D932,808 S 10/2021 Keeley
11,140,999 B2 10/2021 Peterson et al.
11,229,297 B2 1/2022 Gaunt
2002/0069462 A1 6/2002 Gaboury et al.
2002/0129448 A1 * 9/2002 Pirzada ..... A47C 27/081 5/713
2003/0192127 A1 * 10/2003 Cook ..... A47C 27/082 5/713
2003/0221261 A1 * 12/2003 Torbet ..... A47C 27/082 5/709
2005/0204475 A1 9/2005 Schmitz et al.
2005/0235417 A1 10/2005 Koughan et al.
2008/0052830 A1 3/2008 Koughan et al.
2010/0043148 A1 2/2010 Rose et al.
2012/0096648 A1 * 4/2012 Chan ..... A47C 27/001 5/715
2013/0025068 A1 * 1/2013 Chunglo ..... A47C 27/14 5/739
2014/0250597 A1 9/2014 Chen et al.
2014/0310881 A1 * 10/2014 Wyatt ..... A61G 7/05784 5/709
2015/0007393 A1 1/2015 Palashewski
2015/0182418 A1 7/2015 Zaiss
2015/0289667 A1 * 10/2015 Oakhill ..... A47C 27/18 5/423
2017/0156519 A1 * 6/2017 Cheng ..... A47C 7/383
2018/0125259 A1 5/2018 Peterson et al.
2019/0082855 A1 3/2019 Brosnan et al.
2019/0290013 A1 * 9/2019 Boyd ..... A47C 27/083
2020/0187667 A1 6/2020 Shakal
2020/0268163 A1 * 8/2020 Duvert ..... A47C 27/083
2020/0359805 A1 11/2020 Brosnan et al.
2020/0375369 A1 12/2020 Negus et al.
2020/0400135 A1 12/2020 Shakal et al.
2021/0145183 A1 5/2021 Negus et al.
2021/0145185 A1 5/2021 Negus et al.
2021/0177155 A1 6/2021 McGuire et al.
2021/0244196 A1 8/2021 Hilden et al.
2021/0244197 A1 * 8/2021 Oswald ..... A47C 27/15
2021/0251392 A1 8/2021 Shakal
2021/0330090 A1 10/2021 Shakal et al.
2021/0341006 A1 11/2021 Griffith et al.
2021/0378413 A1 * 12/2021 Ohno ..... A47C 27/083
2022/0167753 A1 * 6/2022 Rasmussen ..... A47C 27/05
2022/0192388 A1 6/2022 Smith et al.
2022/0218116 A1 7/2022 Rose et al.
2022/0273118 A1 9/2022 Peterson et al.
2022/0296002 A1 * 9/2022 Long ..... A47C 27/15
2022/0322840 A1 10/2022 Gaunt

OTHER PUBLICATIONS

U.S. Appl. No. 14/594,843, filed Jan. 12, 2015, Rose et al.
U.S. Appl. No. 17/006,388, filed Oct. 31, 2022, Stusynski et al.
U.S. Appl. No. 17/410,424, filed Aug. 24, 2021, Doffing et al.
U.S. Appl. No. 17/743,857, filed May 13, 2022, Rose et al.
U.S. Appl. No. 17/859,189, filed Jul. 7, 2022, Molina et al.
U.S. Appl. No. 17/862,836, filed Jul. 12, 2022, Karschnik et al.
U.S. Appl. No. 17/891,573, filed Aug. 19, 2022, Shakal.
U.S. Appl. No. 17/968,983, filed Oct. 19, 2022, Karschnik et al.
U.S. Appl. No. 29/719,090, filed Dec. 31, 2019, Kirk et al.

(56) References Cited

OTHER PUBLICATIONS

U.S. Appl. No. 29/807,154, filed Sep. 9, 2021, Negus.
U.S. Appl. No. 29/821,785, filed Jan. 3, 2022, Negus et al.
International Search Report and Written Opinion in International Appln. No. PCT/US2022/036773, mailed on Oct. 17, 2022, 15 pages.
International Preliminary Report on Patentability in International Appln. No. PCT/US2022/036773, mailed on Feb. 1, 2024, 9 pages.

* cited by examiner

MULTI-AIR CHAMBER MATTRESS WITH LOCALIZED SUPPORT

CROSS-REFERENCE TO RELATED APPLICATIONS

This application claims priority to U.S. Provisional Application Ser. No. 63/223,253, filed on Jul. 19, 2021, the disclosure of which is incorporated by reference in its entirety.

TECHNICAL FIELD

This document describes devices, systems, and methods related to mattresses with air chambers and foam support.

BACKGROUND

In general, a bed is a piece of furniture used for sleeping and relaxing. Many modern beds include a soft mattress on a bed frame. The mattress may include springs, foam material, and/or air chambers to support the weight of one or more users. Various features and systems have been used in conjunction with beds, including pressure adjustment systems for adjusting firmness of one or more users of the bed.

SUMMARY

The document generally relates to mattresses with multiple interconnected air chambers that can be spaced by foam or some other intermediary structure other than the air chambers. More specifically, the document relates to air mattress systems with a plurality of air chambers that can be positioned in such a way to provide support and sleeper spine alignment through a full range of firmness pressure settings.

Pressure distribution and support (e.g., spine alignment) can be impacted in differing ways when a firmness is increased or decreased for an air mattress system. In some air mattress systems, when air pressure is decreased in air chambers of the mattress, the mattress can become more comfortable but spine alignment can be reduced. Reduced spine alignment can cause decompression in portions of the user's body, which can negatively impact the user's sleep quality.

Some embodiments described herein include an air mattress system, which can have adjustable air chambers designed to increase or decrease surface firmness while providing spine alignment and comfort for the user. The air chambers can be configured in a way to allow for improved pressure distribution while also targeting a supportive result for one or more users of the mattress system. For example, some embodiments described herein include two separate air chambers, one located below a hip region and the other located below a shoulder region of the mattress. The two air chambers can be fluidly connected and driven or adjusted by a single pressure signal. Space between the two chambers can be filled with a foam support or other similar material and/or structure. In some embodiments, multiple foam supports can be positioned between the two air chambers. In some embodiments, one or more foam inserts can also be positioned between each of the air chambers and head and/or foot ends of the mattress system. In some embodiments, the mattress system can have two sections (i.e. left and right sections) to accommodate two users on the bed. Each of the sections can include a set of air chambers and one or more foam inserts. Pressure can then be adjusted for each section based on preferences of each of the two users.

Some embodiments described herein include a mattress comprising: a first air chamber, a second air chamber fluidly connected to the first air chamber, and a foam insert positioned between the first air chamber and the second air chamber.

In some implementations, the mattress can optionally include one or more of the following features. For example, the first air chamber can be positioned at a shoulder region of the mattress and the second air chamber can be positioned at a hip region of the mattress. The first air chamber and the second air chamber can have a common internal pressure. Decreasing the common internal pressure in the first air chamber and the second air chamber can cause the foam insert positioned between the first air chamber and the second air chamber to increase support at a lumbar region of the mattress.

As another example, one or more additional foam inserts can be positioned between at least one of (i) the first air chamber and a head end of the mattress, (ii) the first air chamber and the second air chamber, and (iii) the second air chamber and a foot end of the mattress. The mattress can also include a foam rail structure including a head portion, a foot portion, and first and second side portions, the foam rail structure configured to extend around a perimeter of the mattress to surround the first air chamber, the foam insert, and the second air chamber. The second air chamber can extend from a hip region of the mattress to a location adjacent to an inner surface of the foot portion of the foam rail structure. The first air chamber can extend from a location adjacent to an inner surface of the head portion of the foam rail structure to a shoulder region of the mattress.

As yet another example, the foam insert can include a foam cushion. The foam insert can include a rectangular open cell foam cushion positioned between the first air chamber and the second air chamber at a location exterior to both the first air chamber and the second air chamber. The foam insert can be positioned between the first air chamber and the second air chamber so as to physically separate the first air chamber from the second air chamber longitudinally.

The mattress can further include a first section extending longitudinally between a head end and a foot end of the mattress and extending laterally between a left side and a midline of the mattress, and a second section extending longitudinally between the head end and the foot end of the mattress and extending laterally between a right side and the midline of the mattress. The first section can include the first air chamber, the second air chamber, and the foam insert, and the second section can include a third air chamber, a fourth air chamber fluidly connected to the third air chamber, and a second foam insert positioned between the third air chamber and the fourth air chamber.

In some implementations, the third air chamber and the fourth air chamber can have a second common internal pressure, wherein the second common internal pressure is different than the common internal pressure of the first air chamber and the second air chamber. The foam insert within the first section can have a first firmness level and the second foam insert within the second section can have a second firmness level, wherein the first firmness level is different than the second firmness level.

In some implementations, the mattress can also include a foam layer positioned between a top surface of the mattress and each of (i) the first air chamber, (ii) the second air chamber, and (iii) the foam insert.

Some embodiments described herein include a mattress extending longitudinally between a head end and a foot end and extending laterally between left and right sides, the mattress including a first air chamber, a second air chamber fluidly connected to the first air chamber so as to have a common internal pressure in the first and second air chambers, and a first foam insert positioned between the first air chamber and the second air chamber so as to physically separate the first air chamber from the second air chamber longitudinally.

In some implementations, the mattress can optionally include one or more of the following features. For example, the mattress can also include a foam rail structure including a head portion, a foot portion, and first and second side portions. The foam rail structure can extend around a perimeter of the mattress, wherein the first air chamber can be positioned at a shoulder region of the mattress and extending laterally between locations adjacent to inner surfaces of the first and second side portions of the foam rail structure, and the second air chamber can be positioned at a hip region of the mattress and extending laterally between the locations adjacent to the inner surfaces of the first and second side portions of the foam rail structure.

The mattress can also include a second foam insert positioned between the first air chamber and a location adjacent to an inner surface of the head portion of the foam rail structure and extending laterally between locations adjacent to inner surfaces of the first and second side portions of the foam rail structure. In some implementations, the mattress can also include a third foam insert positioned between the second air chamber and a location adjacent to an inner surface of the foot portion of the foam rail structure and extending laterally between the locations adjacent to the inner surfaces of the first and second side portions of the foam rail structure. Sometimes, the second air chamber can extend longitudinally between the first foam insert and the location adjacent to the inner surface of the foot portion of the foam rail structure.

Some embodiments described herein include a mattress extending longitudinally between a head end and a foot end and extending laterally between a left side and a right side, the mattress having a first section extending longitudinally between the head end and the foot end and extending laterally between the left side and a midline of the mattress. The first section can include a first air chamber, a second air chamber fluidly connected to the first air chamber so as to have a first common internal pressure in the first and second air chambers, and a first foam insert positioned between the first air chamber and the second air chamber so as to physically separate the first air chamber from the second air chamber longitudinally. The mattress can also have a second section extending longitudinally between the head end and the foot end and extending laterally between the right side and the midline of the mattress. The second section can include a third air chamber, a fourth air chamber fluidly connected to the third air chamber so as to have a second common internal pressure in the third and fourth air chambers, and a second foam insert positioned between the third air chamber and the fourth air chamber so as to physically separate the third air chamber from the fourth air chamber longitudinally.

In some implementations, the mattress can optionally include one or more of the following features. For example, the mattress can further include a pump system having one or more air pumps fluidly connected to the first, second, third, and fourth air chambers. The pump system can be configured to inflate the first and second air chambers to the first common internal pressure and to inflate the third and fourth air chambers to the second common internal pressure, wherein the second common internal pressure can be different than the first common internal pressure.

The mattress can also include means for inflating the first and second air chambers to the first common internal pressure and inflating the third and fourth air chambers to the second common internal pressure. The mattress can also include means for containing the first, second, third, and fourth air chambers, the first and second foam inserts, and a foam layer positioned on top of each of the first, second, third, and fourth air chambers and the first and second foam inserts.

The devices, system, and techniques described herein may provide one or more of the following advantages. For example, the disclosed embodiments provide for improved spine alignment, stability, and surface continuity. For example, as air chamber pressure is uniformly decreased for the two air chambers, hip and shoulder regions can sink into the mattress, all while core and lumbar regions can remain supported by the foam insert between the two air chambers. As the air chambers deflate, the user's body can sink into the mattress more at the air chambers which can result in the foam providing more support to the user in waist/lumbar regions of the user's body. This added increased support in the waist and lumbar regions can enable an improved spine alignment for the user. Moreover, the improved spine alignment can be advantageous to improve overall sleep quality of the user. With better spine alignment, users can experience better sleep and more comfort.

As another example, some disclosed embodiments can provide for user customization of the air mattress system. The air chambers and foam inserts can be movably positioned within a rail structure of the mattress. As a result, the user can move a position or location of any of the air chambers and the foam inserts. The user can also swap out any one of the air chambers and foam inserts with other air chambers and/or foam inserts. For example, the user can insert one or more foam inserts having different firmness levels. The user may desire a firmer foam insert rather than a less firm foam insert. In other words, components of the air mattress system can be interchangeable by the user with increased and/or decreased firmness depending on the user's comfort preferences. The user can also insert multiple foam inserts in one or more regions in the mattress, between one or both of the two air chambers and one or both of the head end of the mattress and the foot end of the mattress. As another example, the components of the air mattress system can be moved or shifted between different zones or regions of the mattress system to accommodate for different user heights and/or comfort preferences. The user can change where each of the air chambers and/or the foam insert(s) is positioned within the mattress system. For example, a taller user can move the second air chamber closer to the foot end of the mattress to accommodate for their height. A shorter user can move the second air chamber closer to the head end of the mattress (e.g. closer to the first air chamber).

As another example, an air mattress system can have two sections, each with air chambers and foam insert(s) that can be customizable by two users of the bed. Therefore, when two users are sleeping in the bed, each user can adjust pressure settings for their respective air chambers. Each user can also move the air chambers and foam inserts in each of their respective sections. The disclosed embodiments can provide for each user to adjust their comfortability preferences independent of the other user.

As another example, the air chambers can be a same size, which can be cost effective in manufacturing and production of the air mattress system. The user can also replace or swap out one or more of the air chambers with differently sized chambers. Doing so can accommodate to the user's comfort preferences. For example, the user can swap out the second air chamber with a longer air chamber that extends from the hip region to the foot end of the mattress.

In embodiments where two (or more) air chambers are fluidly connected, a single pressure setting can be used when adjusting firmness of the mattress, which can provide a relatively simple system for a user to adjust mattress firmness. Using a single pressure setting can also provide for consistent spinal alignment (as opposed to allowing different pressure settings in each chamber which can result in one chamber being undesirably firm as compared to another chamber). Therefore, parts of the user's body can be balanced across the top surface of the mattress system. Moreover, fluid connection of the air chambers can provide for less costly manufacturing and greater ease in maintenance or fixing components of the system as described herein.

The details of one or more implementations are set forth in the accompanying drawings and the description below. Other features and advantages will be apparent from the description and drawings, and from the claims.

BRIEF DESCRIPTION OF THE DRAWINGS

Like reference symbols in the various drawings indicate like elements.

DETAILED DESCRIPTION OF ILLUSTRATIVE EMBODIMENTS

This document generally relates to air mattress systems with foam or other suitable support and a plurality of air chambers that can be positioned in such a way to provide support and sleeper spine alignment through a range of firmness pressure settings.

Figure 1:
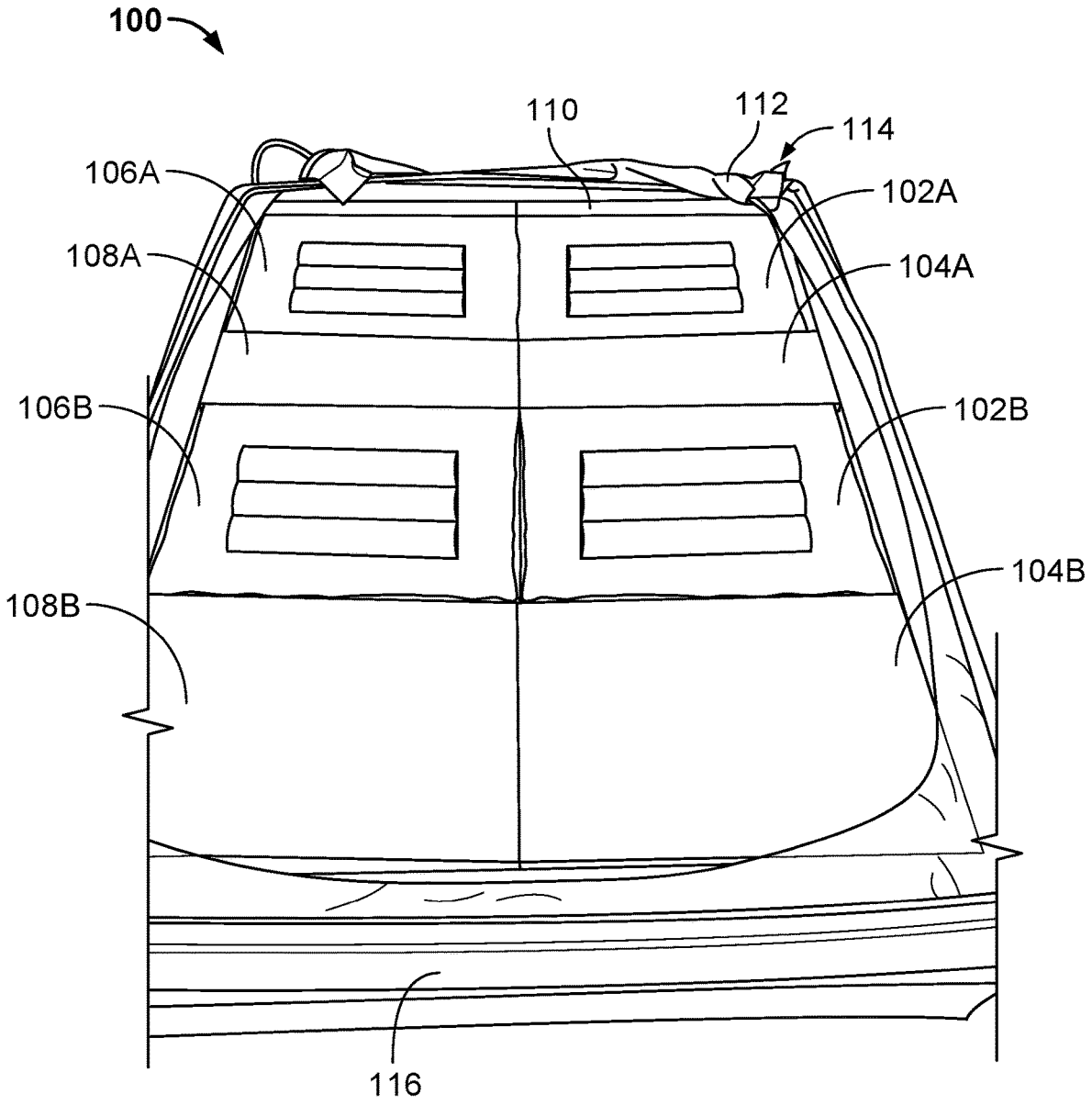
FIG. 1 is an example mattress system as described herein.

Referring to the figures, FIG. 1 is an example mattress system 100 as described herein. The mattress system 100 is depicted upside down to show components contained therein. The mattress system 100 can include a rail structure 110, a first air chamber 102A, a second air chamber 102B, a first foam insert 104A, a second foam insert 104B, a third air chamber 106A, a fourth air chamber 106B, a third foam insert 108A, and a fourth foam insert 108B. The first and second air chambers 102A and 102B and the first and second foam inserts 104A and 104B can be part of a first section of the mattress 100 that extends longitudinally between a head end 114 and a foot end 116 of the mattress system 100 and extends laterally between a right side and a midline of the mattress system 100. The third and fourth air chambers 106A and 106B and the third and fourth foam inserts 108A and 108B can be part of a second section of the mattress system 100 that extends longitudinally between the head end 114 and the foot end 116 of the mattress system 100 and extends laterally between a left side and the midline of the mattress system 100, as depicted in FIG. 1.

The rail structure 110 can be a foam structure positioned around a perimeter of the mattress system 100. The rail structure 110 can provide some shape and/or structural support to the mattress system 100. In some implementations, one or more additional foam layers can be inserted between the rail structure 110 and one or more of the chambers 102A and 106A at the head end 114 of the mattress system 100, as depicted and described further in reference to FIG. 6. The additional foam layers can be advantageous to help with positioning the chambers 102A and 106A farther away from the head end 114 of the mattress system 100. Such a configuration can be preferred by a user who is shorter in height in comparison to a taller user.

The first, second, third, and/or fourth foam inserts 104A, 104B, 108A, and 108B, respectively, can be made of foam or some similar type of cushioning material, such as synthetic support materials (i.e. polymer materials) or natural support materials. In some implementations, all the foam inserts 104A, 104B, 108A, and 108B can have a same firmness level. Any one or more of the foam inserts 104A, 104B, 108A, and 108B can also have different firmness levels, based on user preference or as otherwise suitable for the application. For example, foam inserts that are positioned around the lumbar region of the mattress system 100 can be more firm than foam inserts positioned around the foot region of the mattress system 100. Any one or more of the foam inserts 104A, 104B, 108A, and/or 108B can also include a rectangular open cell foam cushion. Such a foam cushion can, for example, be positioned between the first and second air chambers 102A and 102B and/or the third and fourth air chambers 106A and 106B at a location exterior to both sets of chambers 102A and 102B and 106A and 106B. As depicted throughout the disclosure, the foam inserts 104A, 104B, 108A, and 108B can be positioned between the first and second air chambers 102A and 102B and the third and fourth air chambers 106A and 106B, respectively, so as to physically separate the first air chamber 102A from the second air chamber 102B longitudinally and the third air chamber 106A from the fourth air chamber 106B longitudinally. One or more of the foam inserts 104A, 104B, 108A, and 108B can have different or same firmness levels based on user preference.

One or more of the first, second, third, and fourth foam inserts 104A, 104B, 108A, and 108B can be insertable and moveable inside the rail structure 110. Therefore, any one or more of the foam inserts 104A, 104B, 108A, and 108B can be replaced, switched with other supports, and otherwise moved to different regions or locations within the mattress system 100 as desired by the user. In some implementations, one or more of the foam inserts 104A, 104B, 108A, and 108B can be attached to the rail structure 110. For example, one or more of the foam inserts 104A, 104B, 108A, and 108B can be attached to a rail structure 110 using laminate, glue, adhesives, buttons, snaps, hook-and-loop fasteners, and/or zippers. In some implementations, one or more of the foam inserts 104A, 104B, 108A, and 108B can removably attach to the rail structure 110 to retain it in place but also to provide customization of component arrangement within the mattress system 100.

The mattress system 100 can be sized in a number of suitable mattress sizes, including Full, Queen, and King sized beds. In some of such implementations, the mattress system 100 can include a first zone having the first air chamber 102A, the second air chamber 102B, the first foam insert 104A, and the second foam insert 104B. The mattress system 100 can also include a second zone having the third air chamber 106A, the fourth air chamber 106B, the third foam insert 108A, and the fourth foam insert 108B. The first zone can be used by a first user and the second zone can be used by a second user. In some implementations, such as with Full, Twin, or Single beds, the mattress system 100 may only include the first air chamber 102A, the second air chamber 102B, the first foam insert 104A, and the second foam insert 104B. The second air chamber 102B can be fluidly connected to the first air chamber 102A. Similarly, the fourth air chamber 106B can be fluidly connected to the third air chamber 106A in the mattress system 100 that is Full, Queen, and/or King sized. As a result, a single zone air pressure (e.g., common internal pressure) can be maintained between the first and second air chambers 102A and 102B and the third and fourth air chambers 106A and 106B, respectively. Maintaining the single zone air pressure can be advantageous to make controlling adjustability settings of the mattress system 100 easier for a user or users. Moreover, maintaining single zone air pressures can reduce manufacturing costs of the mattress system 100. For example, all air chambers can be produced in a same size having same pressure settings and adjustability features. As a result, if air chambers need to be fixed, swapped out, or otherwise replaced, maintenance costs can be lower and more affordable. Fixing any of the air chambers used in the mattress system 100 can be easier and faster.

Maintaining a single air pressure between the first and second air chambers 102A and 102B and the third and fourth air chambers 106A and 106B can further provide spine alignment and lumbar support. Therefore, when air pressure is adjusted, portions of the user's body can be aligned relatively well both before and after the pressure adjustment. As pressure is uniformly decreased from the first and second air chambers 102A and 102B, the foam inserts 104A and 104B will not deflate with the chambers 102A and 102B. Therefore, the foam inserts 104A and 104B provide continuous support to waist, and/or lower leg regions to maintain or even improve spine alignment and overall comfortability, even when the user desires to lower pressure levels of the chambers 102A and 102B in the mattress system 100. Therefore, decreasing the common internal pressure in the first and second air chambers 102A and 102B can cause the foam insert 104A positioned between the chambers 102A and 102B to maintain or even increase support at the lumbar region of the mattress system 100.

As shown in FIG. 1, the first and third air chambers 102A and 106A can be positioned at the shoulder region of the mattress system 100 and the second and fourth air chambers 102B and 106B can be positioned at the hip region of the mattress system 100. One or more other configurations can be realized based on user preference and as described throughout this disclosure. The first air chamber 102A can be positioned at a head end 114 of the mattress system 100 around a shoulder region. The first foam insert 104A can be positioned between the first air chamber 102A and the second air chamber 102B and the second foam insert 104B can be positioned between the second air chamber 102B and a foot end 116 of the mattress system 100. The third air chamber 106A, the fourth air chamber 106B, the third foam insert 108A, and the fourth foam insert 108B are similarly positioned. Any one or more of the components can also be arranged in different configurations, as described throughout this disclosure (e.g., refer to FIGS. 3-6). Furthermore, one or more of the components, such as the first, second, third, and fourth foam inserts 104A, 104B, 108A, and 108B, respectively, can be removed and/or replaced based on user preference. In some implementations, one or more additional foam inserts can be positioned between at least one of the first air chamber 102A and the head end 114 of the mattress system 100, the first air chamber 102A and the second air chamber 102B, and the second air chamber 102B and the foot end 116 of the mattress system 100 (e.g., refer to FIGS. 3-6).

Moreover, as depicted, the components of the mattress system 100 are arranged inside a perimeter formed by the rail structure 110. The rail structure 110 can be a foam structure (or other material suitable for the application) that can maintain the components described herein in place when the mattress system 100 is moved and used. The rail structure 110 can therefore be positioned around a perimeter of the mattress system 100.

The mattress can also include a mattress cover 112. The mattress cover 112 can cover the components described herein to also maintain the components in place. The mattress cover 112 can be made of one or more fabrics or other similar textile materials. The mattress cover 112 can enclose the entire mattress system 100. The mattress cover 112 can also contain one or more foam layers (not shown in FIG. 1) that can be positioned on top of each of the first, second, third, and fourth air chambers 102A, 102B, 106A, and 106B, respectively, as well as the first, second, third, and fourth foam inserts 104A, 104B, 108A, and 108B, respectively.

Figure 8:
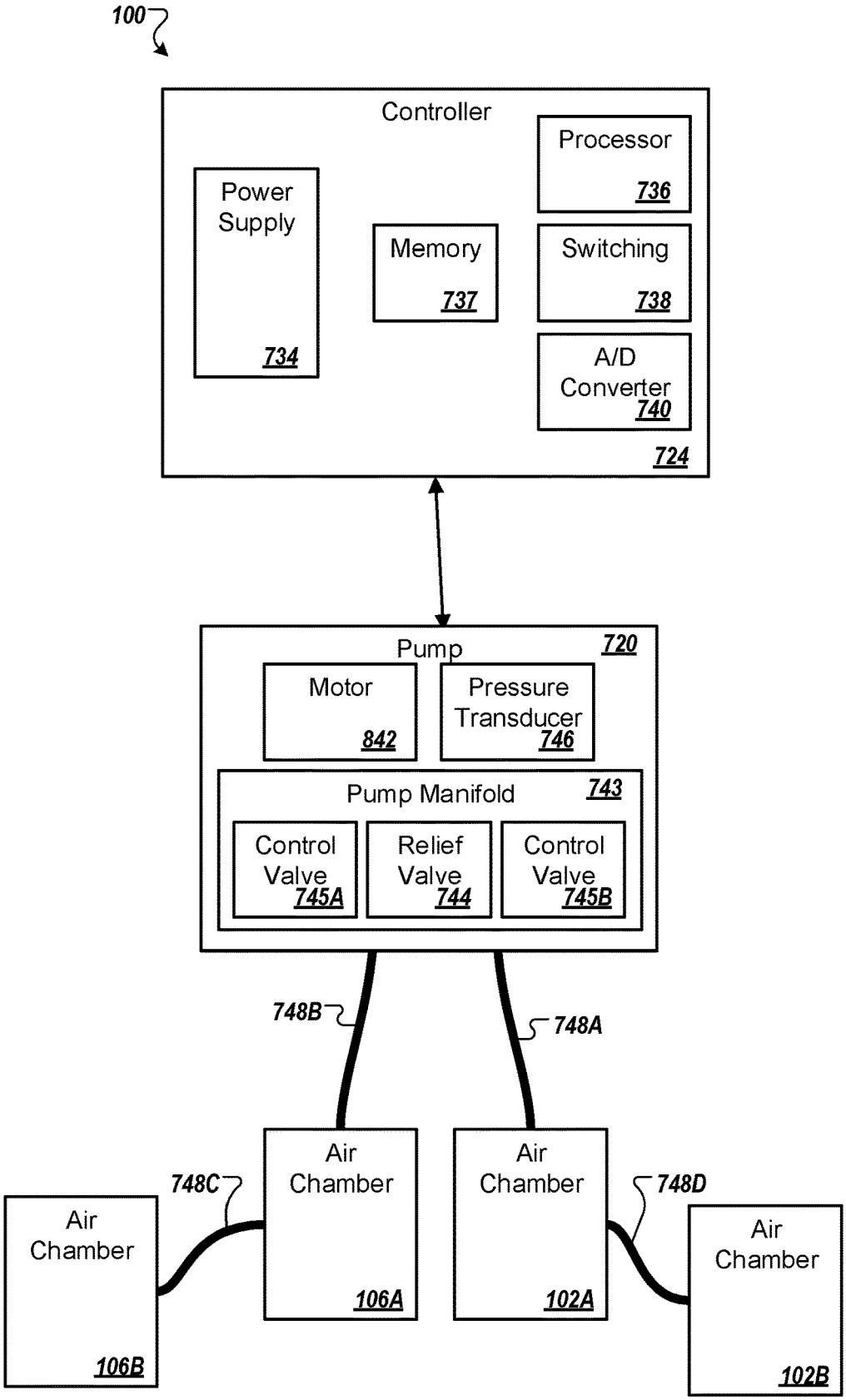
FIG. 8 is a block diagram of an example of various components of the mattress system with the pump.

As depicted in FIGS. 8-9, the mattress system 100 can be in fluid communication (via hoses) to a pump 720. The pump 720 can include one or more air pumps that can be fluidly connected to the first, second, third, and fourth air chambers 102A, 102B, 106A, and 106B, respectively. The pump 720 can be configured to inflate the first and second air chambers 102A and 102B to a first common internal pressure. The pump 720 can also be configured to inflate the third and fourth air chambers 106A and 106B to a second common internal pressure. The first common internal pressure can be different than the second common internal pressure, for example, based on user preference.

Figure 2:
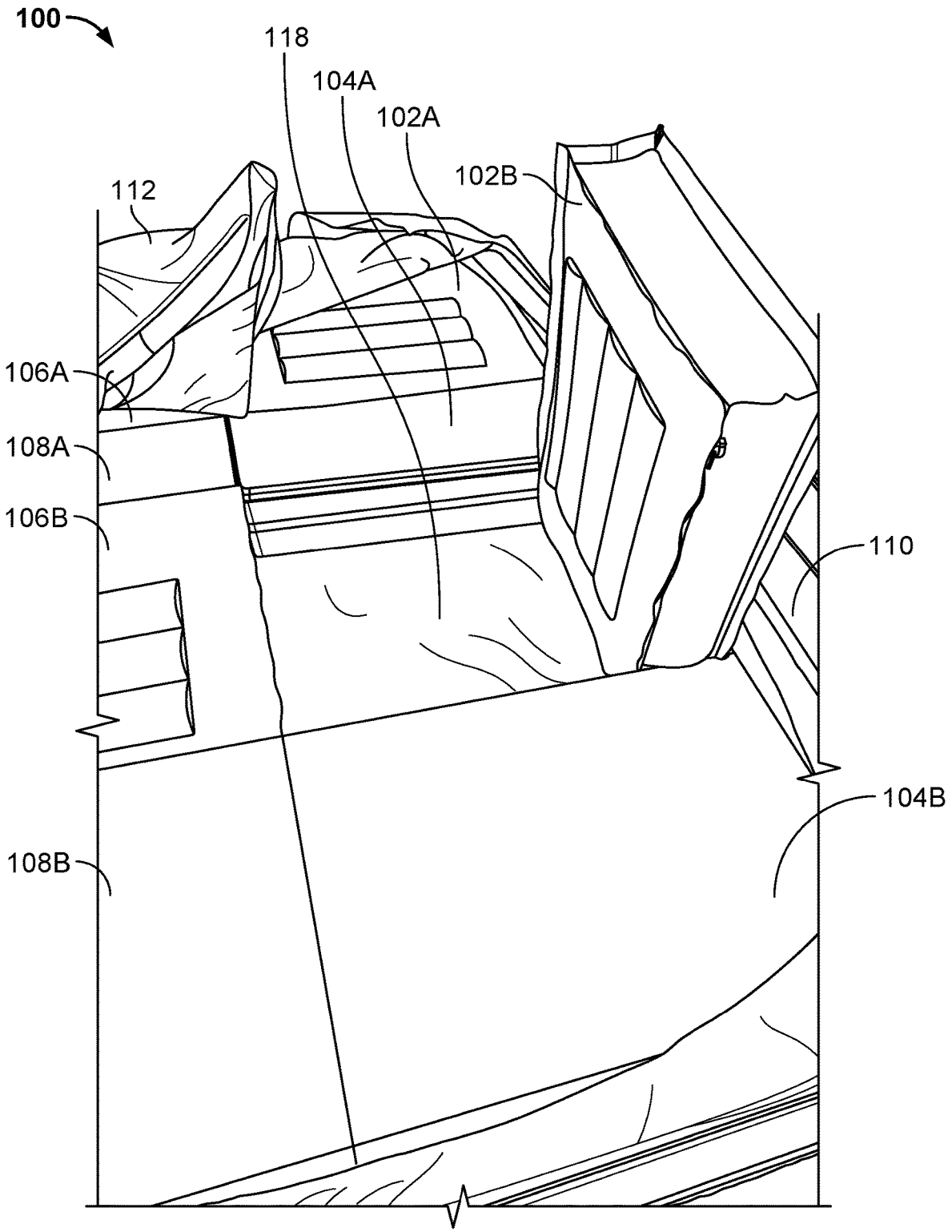
FIG. 2 depicts components of the mattress system described herein.

FIG. 2 depicts the mattress system 100 positioned upside down with a bottom portion of the cover 112 open to show various internal components of the mattress system 100. The mattress system 100 can include a layer 118 positioned between a top surface of the mattress system 100 and each of the first, second, third, and fourth air chambers 102A, 102B, 106A, and 106B as well as the rail structure 110, and the first, second, third, and fourth foam inserts 104A, 104B, 108A, and 108B. The layer 118 can be made of foam or another similar material or cushion. For example, the layer 118 can be formed of one or more viscoelastic foam materials or other materials suitable for the application. The layer 118 can provide comfort to the user when sleeping in the mattress system 100. In some embodiments, the layer 118 can be adhered or otherwise attached to the rail structure 110 to form somewhat of a foam tub. The foam tub (formed by a combination of the layer 118 and the rail structure 110) is, effectively, an upside-down foam tub when the mattress system 100 is flipped right-side-up.

Figure 3:
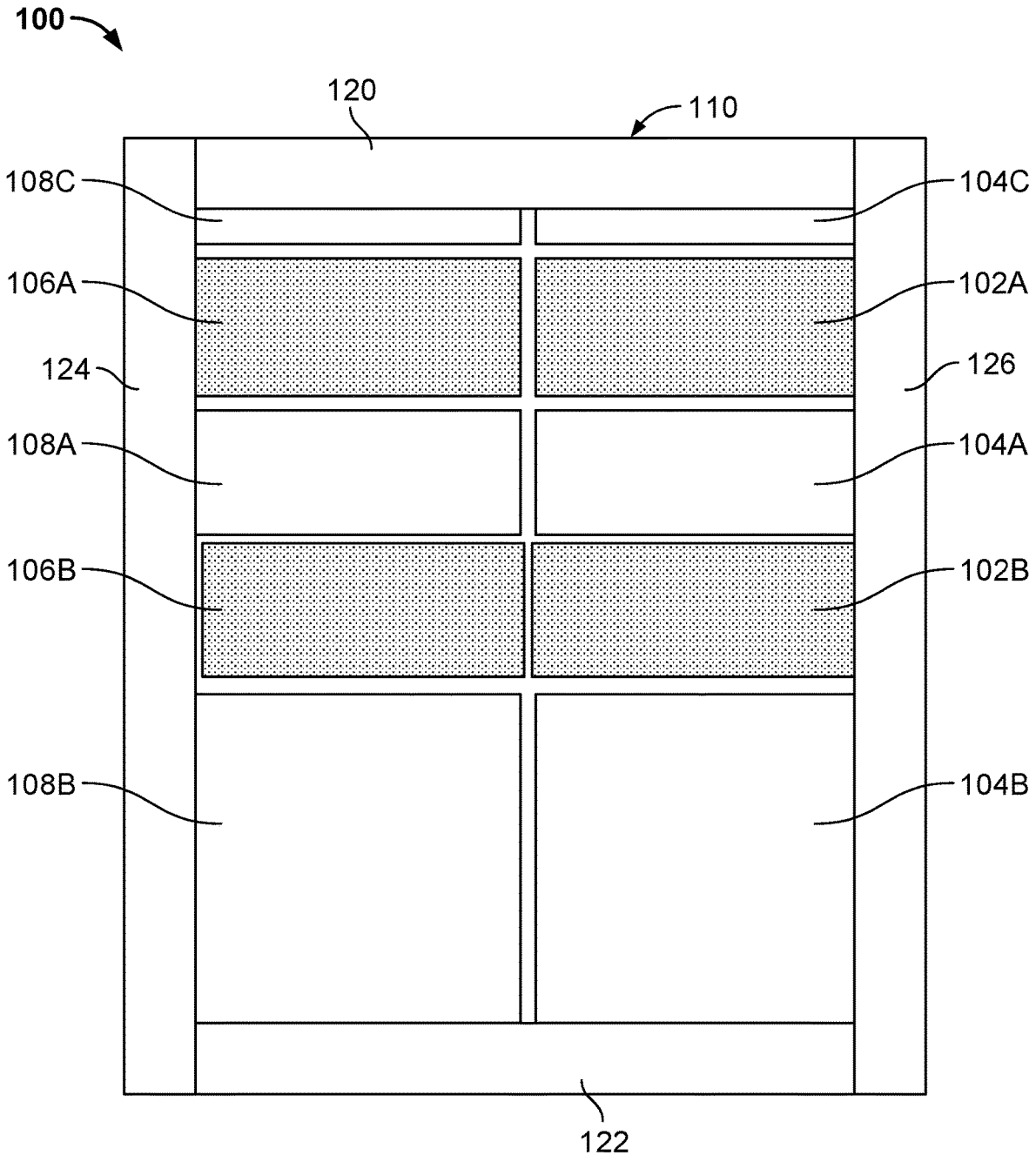
FIG. 3 is an example configuration of components of the mattress system.
Figure 4:
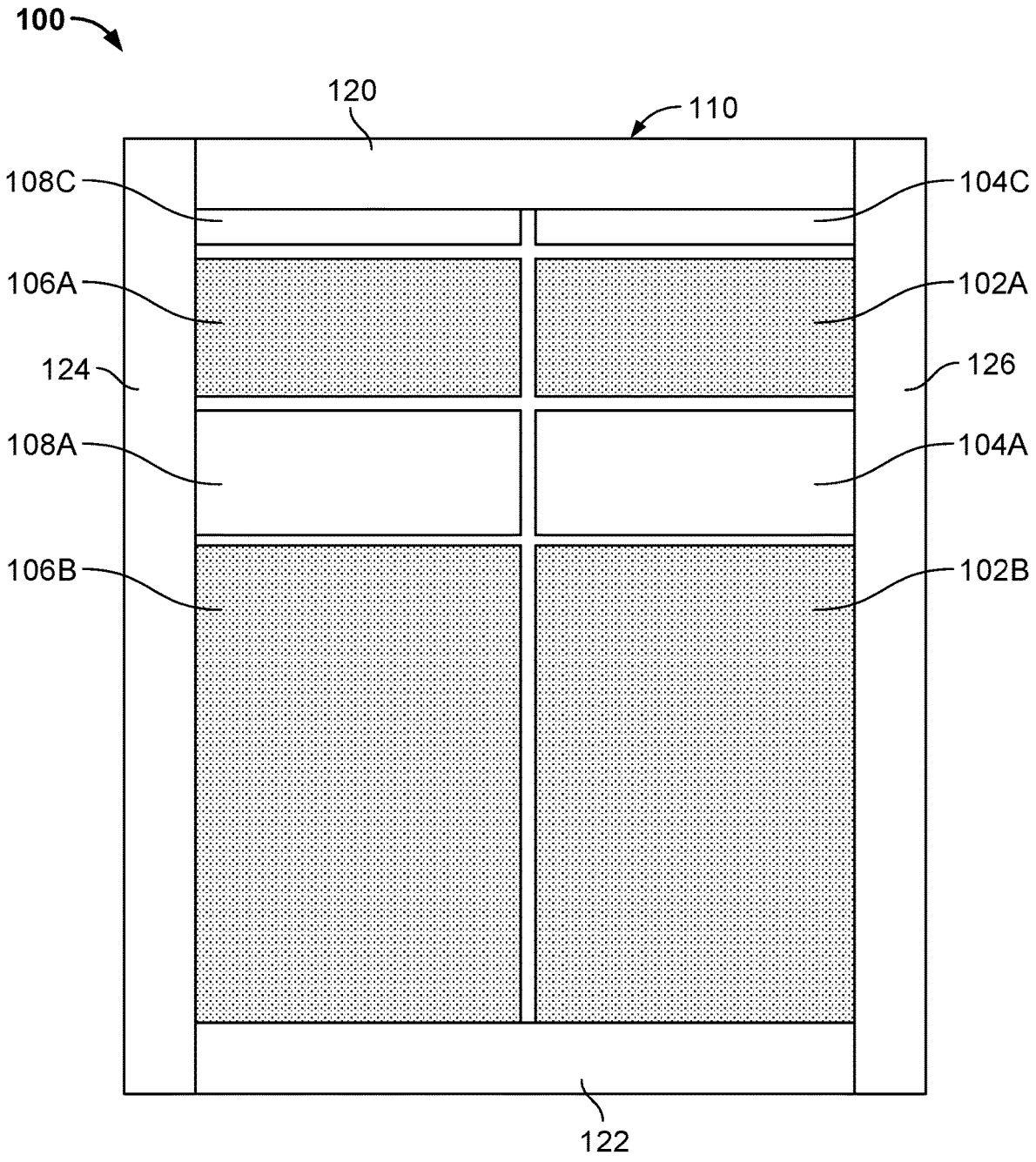
FIG. 4 is another example configuration of components of the mattress system.
Figure 5:
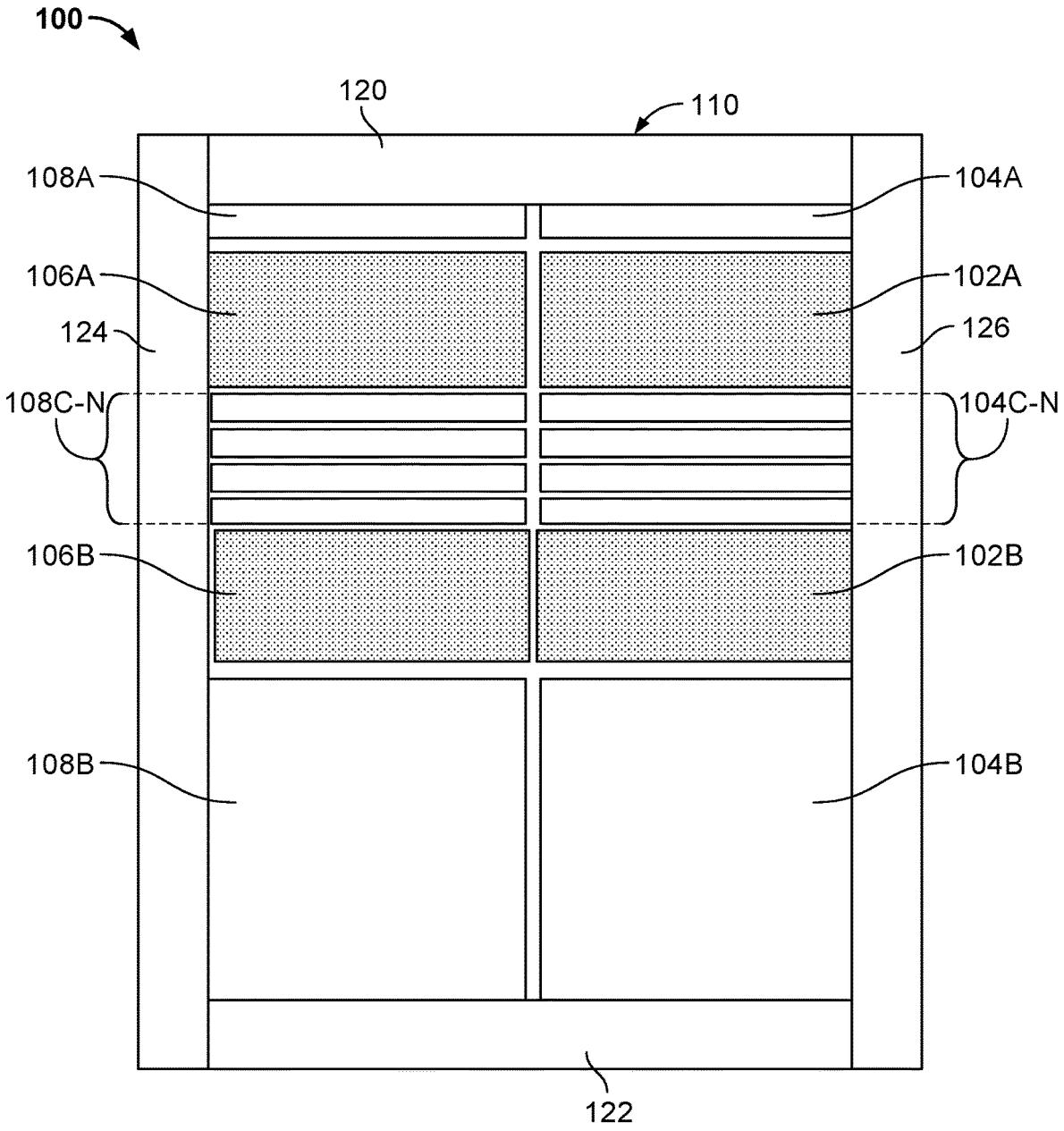
FIG. 5 is another example configuration of components of the mattress system.
Figure 6:
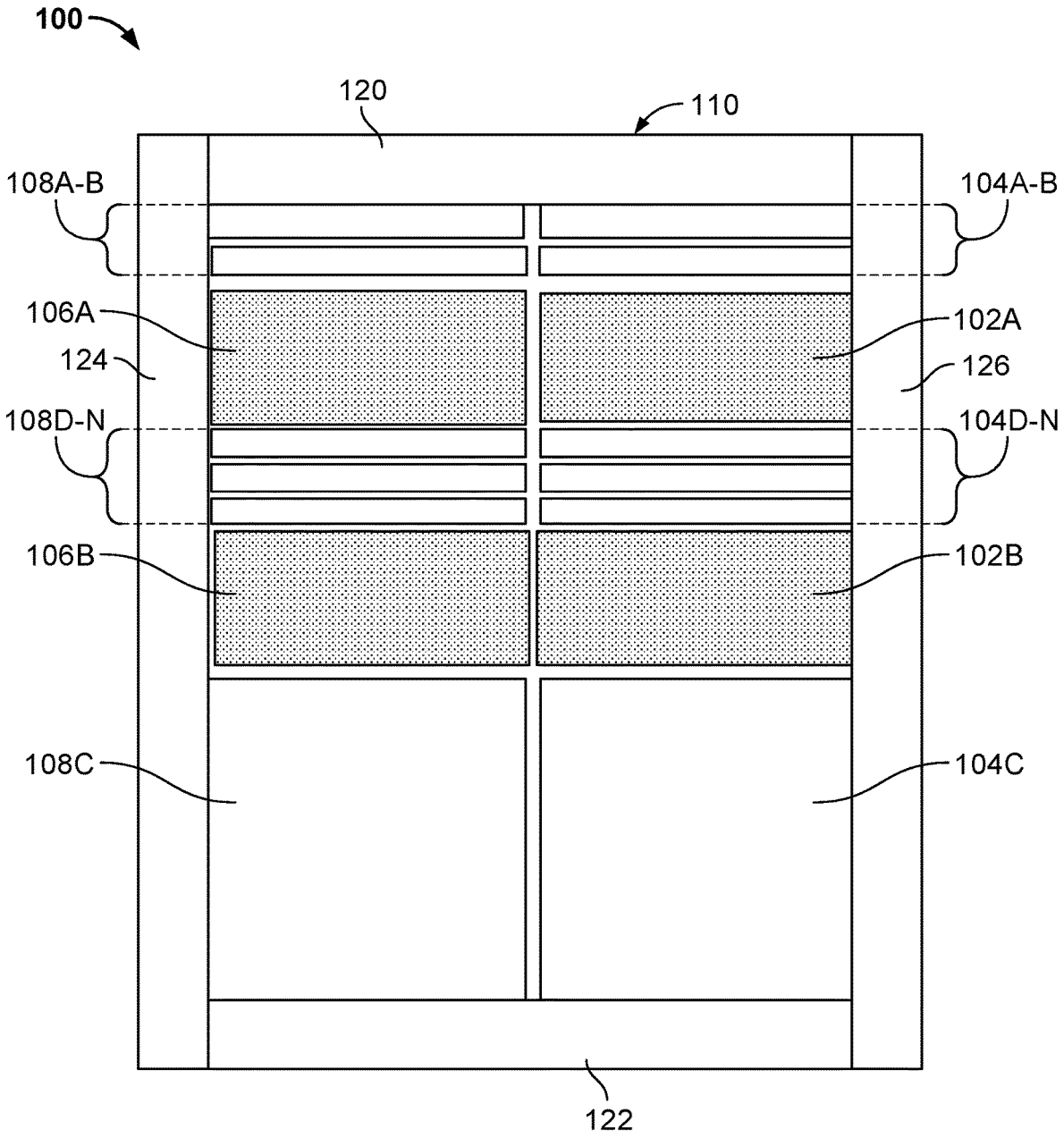
FIG. 6 is another example configuration of components of the mattress system.

FIG. 3 is an example configuration of components of the mattress system 100. FIGS. 4, 5, and 6 are additional example configurations of components of the mattress system 100. The FIGS. 3-6 depict different air chamber and/or foam insert orientations and placements within the mattress 100. As shown in the FIGS. 3-6, the foam inserts can be interchangeable, removed, and/or replaced with other types and/or sizes of foam inserts. One or more users of the mattress system 100 can customize positioning of the components depicted and described throughout this disclosure. For example, a tall user can prefer to position the second air chamber 102B closer to a foot end of the mattress 100 to accommodate for their height. A shorter user can prefer to position the first and second air chambers 102A and 102B closer together to accommodate for their height. As another example, a user can prefer to position multiple firmer foam inserts between the first and second air chambers 102A and 102B to provide more support to their lumbar region.

The air chambers 102A, 102B, 106A, and 106B can be the same size (or substantially the same size) as each other. This can be advantageous for simplicity and also lower cost for manufacturing, repair, and/or replacement, as well as for maintaining all portions of the body balanced and aligned while the pressure settings of the mattress system 100 change. In some implementations, as shown in FIG. 4, one or more of the air chambers 102A, 102B, 106A, and 106B can be different sizes. For example, the second and fourth air chambers 102B and 106B can be longer than the first and third air chambers 102A and 106A (e.g., refer to FIG. 4). In some implementations, the first and second air chambers 102A and 102B can be first sizes and the third and fourth air chambers 104A and 104B can be second sizes, based on user preference. The first and second sizes can be different.

Referring to the FIGS. 3-6, the rail structure 110 can include a head portion 120, a foot portion 122, and first and second side portions 124 and 126. The rail structure 110 can extend around a perimeter of the mattress system 100 to surround the first, second, third, and fourth air chambers 102A, 102B, 106A, and 106B, respectively, as well as the foam inserts as described herein (e.g., foam inserts 104A-C and 108A-C in FIG. 3; 104A, 104C, 108A, and 108C in FIG. 4; 104A-N and 108A-N in FIGS. 5-6). In some implementations, as shown in FIG. 4, the second and fourth air chambers 102B and 106B can extend from a hip region of the mattress system 100 to a location adjacent to an inner surface of the foot portion 122 of the foam rail structure 110. Similarly, the first air chamber 102A can extend from a location adjacent to an inner surface of the head portion 120 of the foam rail structure to a shoulder region of the mattress system 100.

In some implementations, such as where the mattress system 100 has only the first and second air chambers 102A and 102B, the first air chamber 102A can be positioned at the shoulder region of the mattress system 100 and extend laterally between locations adjacent to inner surfaces of the first and second side portions 124 and 126 of the rail structure 110. The second air chamber 102B can be positioned at the hip region of the mattress system 100 and extend laterally between the locations adjacent to the inner surfaces of the first and second side portions 124 and 126 of the rail structure 110.

As depicted in FIGS. 3-6, one or more foam inserts can be positioned between the first and third air chambers 102A and 106A and a location adjacent to an inner surface of the head portion 120 of the rail structure 110 and extend laterally between locations adjacent to inner surfaces of the first and second side portions 124 and 126 of the rail structure 110 and a midline of the mattress system 100. As depicted in FIGS. 3, 5, and 6, one or more foam inserts can be positioned between the second and fourth air chambers 104B and 108B at a location adjacent to an inner surface of the foot portion 122 of the rail structure 110 and extend laterally between the locations adjacent to the inner surfaces of the first and second side portions 124 and 126 of the rail structure 110 and the midline of the mattress system 100.

FIG. 3 depicts a configuration in which foam inserts 104C and 108C are positioned between the head portion 120 of the rail structure 110 and the first and third air chambers 102A and 106A, respectively. Foam inserts 104A and 108A can be positioned between the first and third air chambers 102A and 106A and the second and fourth air chambers 102B and 106B, respectively. Foam inserts 104B and 108B can be positioned between the second and fourth air chambers 102B and 106B and the foot portion 122 of the rail structure 110. In some implementations, the components 102A, 102B, 104A, 104B, and 104C can be arranged differently than the components 106A, 106B, 108A, 108B, and 108C, based on user preferences.

FIG. 4 is another example configuration of components of the mattress system 100. As shown and described throughout, the second and fourth air chambers 102B and 106B can extend from the waist region of the mattress to the foot portion 122 of the rail structure 110. Moreover, as described throughout, a first user can set up the air chambers 102A and 102B as depicted in FIG. 4 and a second user can set up the air chambers 106A and 106B as depicted in any of the other configurations described herein.

FIG. 5 is another example configuration of components of the mattress system 100. One or more users can position multiple foam inserts 104C-N and 108C-N between the first and second air chambers 102A and 102B and the third and fourth air chambers 106A and 106B, respectively. Foam inserts 104C-N and 108C-N can be relatively short to allow a user to move or remove one or more of them while leaving the others in place, thus adjusting the mattress as appropriate for a given user.

FIG. 6 is another example configuration of components of the mattress system 100. One or more users can position one or more foam inserts 104A-B and 108A-B between the head portion 120 of the rail structure 110 and the first and third air chambers 102A and 106A, respectively. One or more users can additionally or alternatively position one or more foam inserts 104D-N and 108D-N between the first and second air chambers 102A and 102B and the third and fourth air chambers 106A and 106B, respectively.

Figure 7:
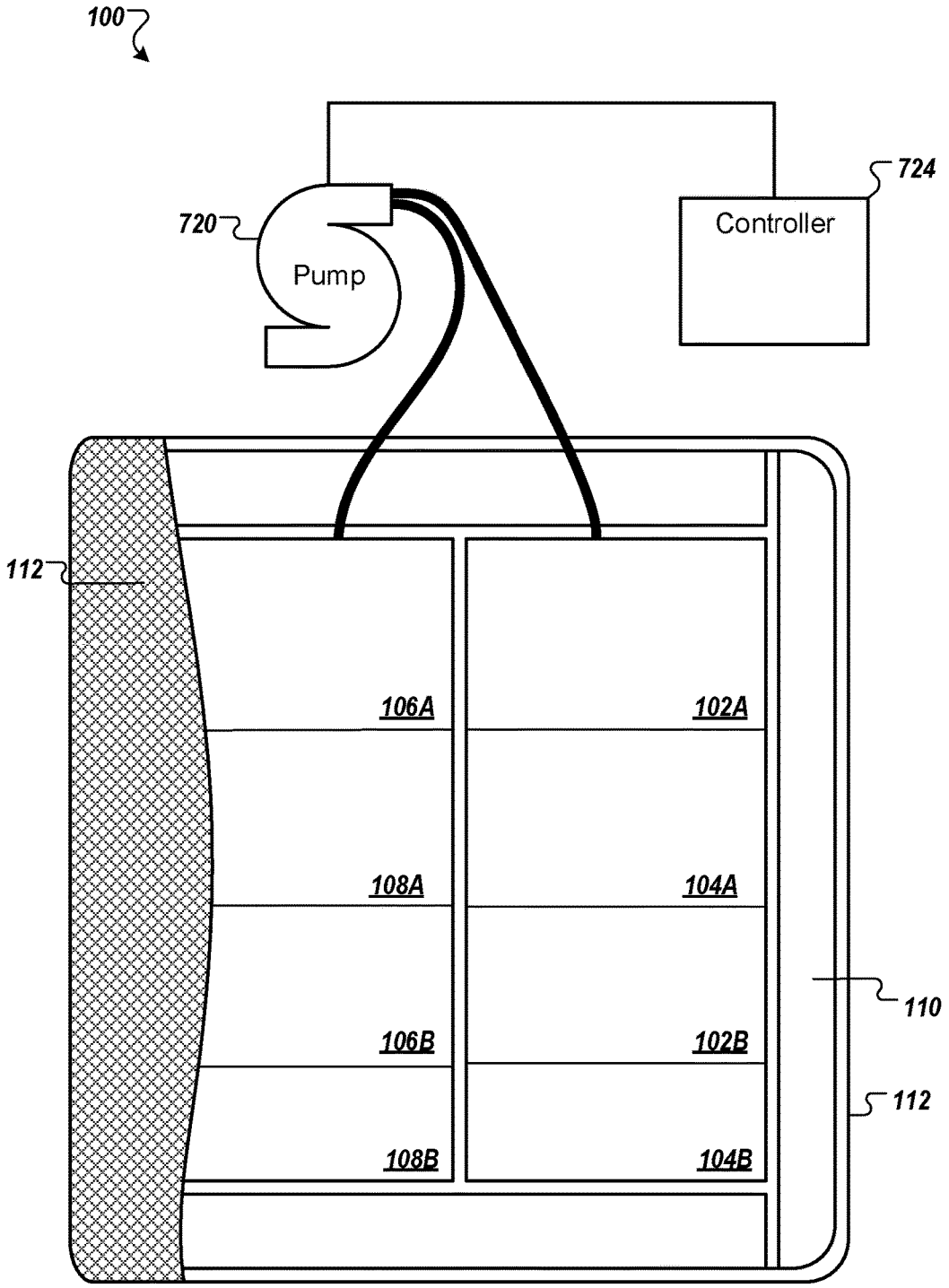
FIG. 7 depicts the example mattress system with a pump.

FIG. 7 depicts the example mattress system 100 with a pump 720 and a controller 724. The controller 724 can be configured to operate the pump 720 to cause increases and decreases in fluid pressure of the first air chamber 102A, the second air chamber 102B, the third air chamber 106A, and the fourth air chamber 106B. In some implementations, the controller 724 is integrated into a housing of the pump 720.

FIG. 8 is a block diagram of an example of various components of the mattress system 100 with the pump 720. As shown in FIG. 8, the controller 724 can include a power supply 734, one or more processors 736, memory 737, a switching mechanism 738, and an analog to digital (A/D) converter 740. The switching mechanism 738 can be, for example, a relay or a solid state switch. In some implementations, the switching mechanism 738 can be located in the pump 720 rather than the controller 724. The controller 724 can be in wired or wireless communication with the pump 720.

The pump 720 can include a motor 842, a pump manifold 743, a relief valve 744, a first control valve 745A, a second control valve 745B, and one or more pressure transducers 746. The pump 720 is fluidly connected with the first air chamber 102A via a first tube 748A and the third air chamber 106A via a second tube 748B. The first air chamber 102A can then be fluidly connected with the second air chamber 102B via a third tube 748D. The third air chamber 106A can be fluidly connected with the fourth air chamber 106B via a fourth tube 748C. The first and second control valves 745A and 745B can be controlled by the switching mechanism 738, and are operable to regulate the flow of fluid between the pump 720 and the first air chamber 102A and also between the pump 720 the third air chamber 106A. The tube 748D can fluidly connect the air chamber 102A to the air chamber 102B so that the pressure in the air chamber 102B is the same or substantially the same as the air pressure in the air chamber 102A. Accordingly, the pump 720 can adjust air pressure in air chambers 102A and 102B at substantially the same time to substantially the same pressure. The tube 748C can fluidly connect the air chamber 106A to the air chamber 106B so that the pressure in the air chamber 106B is the same or substantially the same as the air pressure in the air chamber 106A. Accordingly, the pump 720 can adjust air pressure in air chambers 106A and 106B at substantially the same time to substantially the same pressure.

In some implementations, the pump 720 and the controller 724 can be provided and packaged as a single unit. In some alternative implementations, the pump 720 and the controller 724 can be provided as physically separate units. In some implementations, the controller 724, the pump 720, or both are integrated within or otherwise contained within a bed frame or bed support structure that supports the mattress system 100. In some implementations, the controller 724, the pump 720, or both are located outside of a bed frame or bed support structure.

In some implementations, a separate pump can be associated with each air chamber of the air bed system or a pump can be associated with multiple chambers of the air bed system. Separate pumps can allow each air chamber to be inflated or deflated independently and simultaneously. Furthermore, additional pressure transducers can also be incorporated into the air bed system such that, for example, a separate pressure transducer can be associated with each air chamber.

In use, the processor 736 can, for example, send a decrease pressure command to one of the air chambers 102A and 102B and/or 106A and 106B, and the switching mechanism 738 can be used to convert the low voltage command signals sent by the processor 736 to higher operating voltages sufficient to operate the relief valve 744 of the pump 720 and open the control valve 745A or 745B. Opening the relief valve 744 can allow air to escape from the air chambers 102A and 102B via the respective air tubes 748A and 748D. Opening the relief valve 744 can also allow air to escape from the air chambers 106A and 106B via the respective air tubes 748B and 748C. During deflation, the pressure transducer 746 can send pressure readings to the processor 736 via the A/D converter 740. The A/D converter 740 can receive analog information from pressure transducer 746 and can convert the analog information to digital information useable by the processor 736.

As another example, the processor 736 can send an increase pressure command. The pump motor 842 can be energized in response to the increase pressure command and send air to the designated air chambers 102A and 102B and/or 106A and 106B through the respective tubes 748A and 748D and/or 748B and 748C via electronically operating the corresponding valve 745B or 745A. While air is being delivered to the designated air chambers 102A and 102B and/or 106A and 106B to increase the firmness of the chambers, the pressure transducer 746 can sense pressure within the pump manifold 743. Again, the pressure transducer 746 can send pressure readings to the processor 736 via the A/D converter 740. The processor 736 can use the information received from the A/D converter 740 to determine the difference between the actual pressure in the air chambers 102A and 102B and/or 106A and 106B and the desired pressure.

Generally speaking, during an inflation or deflation process, the pressure sensed within the pump manifold 743 can provide an approximation of the pressure within the respective air chamber that is in fluid communication with the pump manifold 743. An example method of obtaining a pump manifold pressure reading that is substantially equivalent to the actual pressure within an air chamber includes turning off pump 720, allowing the pressure within the air chambers 102A and 102B and/or 106A and 106B and the pump manifold 743 to equalize, and then sensing the pressure within the pump manifold 743 with the pressure transducer 746. Thus, providing a sufficient amount of time to allow the pressures within the pump manifold 743 and air chambers 102A and 102B and/or 106A and 106B to equalize can result in pressure readings that are accurate approximations of the actual pressure within air chambers 102A and 102B and/or 106A and 106B. In some implementations, the pressure of the air chambers 102A and 102B and/or 106A and 106B can be continuously monitored using one or more pressure sensors. In some implementations, the pressure of the air chambers 102A and 102B and/or 106A and 106B can be monitored via another method suitable for the application.

While this specification contains many specific implementation details, these should not be construed as limitations on the scope of the disclosed technology or of what may be claimed, but rather as descriptions of features that may be specific to particular embodiments of particular disclosed technologies. Certain features that are described in this specification in the context of separate embodiments can also be implemented in combination in a single embodiment in part or in whole. Conversely, various features that are described in the context of a single embodiment can also be implemented in multiple embodiments separately or in any suitable subcombination. Moreover, although features may be described herein as acting in certain combinations and/or initially claimed as such, one or more features from a claimed combination can in some cases be excised from the combination, and the claimed combination may be directed to a subcombination or variation of a subcombination. Similarly, while operations may be described in a particular order, this should not be understood as requiring that such operations be performed in the particular order or in sequential order, or that all operations be performed, to achieve desirable results. Particular embodiments of the subject matter have been described. Other embodiments are within the scope of the following claims. For example, in some embodiments the mattress 100 can include more or fewer foam structures and/or air chambers than those illustrated. Moreover, in some embodiments the mattress 100 can include additional features not depicted, such as coil springs, comfort layers, sensors, or other support structures.

What is claimed is:

1. A mattress comprising:

a first pump configured to provide for inflation or deflation during operation;

a first air chamber configured to be fluidly connected to the first pump;

a second air chamber configured to be fluidly connected to the first air chamber and to be fluidly connected to the first pump via the first air chamber; and a foam insert positioned between the first air chamber and the second air chamber, wherein the foam insert is positioned at a lumbar region of the mattress, the first air chamber is positioned at a shoulder region of the mattress and the second air chamber is positioned at a hip region of the mattress, wherein there are no additional air chambers between the first and second air chambers.

2. The mattress of claim 1, wherein the first air chamber and the second air chamber are configured to have a common internal pressure when connected.

3. The mattress of claim 2, wherein the first pump comprises a controller configured to drive the first pump to decrease the common internal pressure in both of the first air chamber and the second air chamber which causes the foam insert positioned between the first air chamber and the second air chamber to increase support at a lumbar region of the mattress.

4. The mattress of claim 1, wherein one or more separate and additional foam inserts are laterally positioned between at least one of (i) the first air chamber and a head end of the mattress, (ii) the first air chamber and the second air chamber, and (iii) the second air chamber and a foot end of the mattress.

5. The mattress of claim 1, further comprising a foam rail structure including a head portion, a foot portion, and first and second side portions, the foam rail structure configured to extend around a perimeter of the mattress to surround the first air chamber, the foam insert, and the second air chamber.

6. The mattress of claim 5, wherein the second air chamber extends from a hip region of the mattress to a location adjacent to an inner surface of the foot portion of the foam rail structure.

7. The mattress of claim 5, wherein the first air chamber extends from a location adjacent to an inner surface of the head portion of the foam rail structure to a shoulder region of the mattress.

8. The mattress of claim 1, wherein the foam insert, the first air chamber, and the second air chamber each have rectangular shapes when viewed from a top, a bottom, a head, a foot, and sides.

9. The mattress of claim 1, wherein the foam insert is positioned continuously between the first air chamber and the second air chamber so as to physically separate the first air chamber from the second air chamber longitudinally with a first edge of the foam insert positioned adjacent the first air chamber and a second edge of the foam insert positioned adjacent the second air chamber.

10. The mattress of claim 1, further comprising a first section extending longitudinally between a head end and a foot end of the mattress and extending laterally between a left side and a midline of the mattress, and a second section extending longitudinally between the head end and the foot end of the mattress and extending laterally between a right side and the midline of the mattress, wherein the first section comprises the first air chamber, the second air chamber, and the foam insert, and the second section comprises a third air chamber configured to be fluidly connected to the first pump, a fourth air chamber configured to be fluidly connected to the third air chamber, and a second foam insert positioned between the third air chamber and the fourth air chamber.

11. The mattress of claim 10, wherein the third air chamber and the fourth air chamber are configured to have a second common internal pressure when connected, wherein the second common internal pressure is different than a first common internal pressure of the first air chamber and the second air chamber.

12. The mattress of claim 10, wherein the foam insert within the first section has a first firmness level and the second foam insert within the second section has a second firmness level, wherein the first firmness level is different than the second firmness level.

13. The mattress of claim 1, further comprising a foam layer positioned between a top surface of the mattress, on the one hand, and each of (i) the first air chamber, (ii) the second air chamber, and (iii) the foam insert, on the other hand, wherein a first height of the first air chamber, a second height of the second air chamber, and a third height of the foam insert are substantially equal.

14. A mattress extending longitudinally between a head end and a foot end and extending laterally between left and right sides, the mattress comprising:

a first air chamber;

a second air chamber having a height equal to the first air chamber and configured to be fluidly connected to the first air chamber so as to have a common internal pressure in the first and second air chambers when connected; and a first foam insert having the height equal to the first air chamber and positioned between the first air chamber and the second air chamber so as to physically separate the first air chamber from the second air chamber longitudinally, wherein the first foam insert, the first air chamber, and the second air chamber each have rectangular shapes when viewed from a top, a bottom, a head, a foot, and sides.

15. The mattress of claim 14, wherein the mattress further comprises a foam rail structure including a head portion, a foot portion, and first and second side portions, wherein the foam rail structure extends around a perimeter of the mattress, wherein the first air chamber is positioned at a shoulder region of the mattress and extending laterally between locations adjacent to inner surfaces of the first and second side portions of the foam rail structure, and the second air chamber is positioned at a hip region of the mattress and extending laterally between the locations adjacent to the inner surfaces of the first and second side portions of the foam rail structure.

16. The mattress of claim 15, further comprising:

a second foam insert positioned between the first air chamber and a location adjacent to an inner surface of the head portion of the foam rail structure and extending laterally between locations adjacent to inner surfaces of the first and second side portions of the foam rail structure; and a third foam insert positioned between the second air chamber and a location adjacent to an inner surface of the foot portion of the foam rail structure and extending laterally between the locations adjacent to the inner surfaces of the first and second side portions of the foam rail structure.

17. The mattress of claim 16, wherein the second air chamber extends longitudinally between the first foam insert and the location adjacent to the inner surface of the foot portion of the foam rail structure.

18. A mattress extending longitudinally between a head end and a foot end and extending laterally between a left side and a right side, the mattress comprising:

one or more air pumps configured to provide for inflation or deflation during operation;

a first section extending longitudinally between the head end and the foot end and extending laterally between the left side and a midline of the mattress, wherein the first section comprises:

a first air chamber configured to be fluidly connected to the one or more air pumps;

a second air chamber configured to be fluidly connected to the first air chamber and to be fluidly connected to the one or more air pumps via the first air chamber so as to have a first common internal pressure in the first and second air chambers, wherein the first air chamber is fluidly connected to no air chambers other than the second air chamber; and a first foam insert positioned between the first air chamber and the second air chamber so as to physically separate the first air chamber from the second air chamber longitudinally; and a second section extending longitudinally between the head end and the foot end and extending laterally between the right side and the midline of the mattress, wherein the second section comprises:

a third air chamber configured to be fluidly connected to the one or more air pumps;

a fourth air chamber configured to be fluidly connected to the third air chamber and to be fluidly connected to the one or more air pumps via the third air chamber so as to have a second common internal pressure in the third and fourth air chambers, wherein the third air chamber is fluidly connected to no air chambers other than the fourth air chamber; and a second foam insert positioned between the third air chamber and the fourth air chamber so as to physically separate the third air chamber from the fourth air chamber longitudinally.

19. The mattress of claim 18, wherein the one or more air pumps is configured to inflate the first and second air chambers to the first common internal pressure and to inflate the third and fourth air chambers to the second common internal pressure, wherein the second common internal pressure can be different than the first common internal pressure.

20. The mattress of claim 18, wherein the first section includes no air chambers other than the first and second air chambers and wherein the second section includes no air chambers other than the third and fourth air chambers.

21. The mattress of claim 1, wherein there are no air chambers positioned under either of the first and second air chambers.

22. The mattress of claim 14, wherein the first foam insert is positioned at a lumbar region of the mattress, the first air chamber is positioned at a shoulder region of the mattress and the second air chamber is positioned at a hip region of the mattress, wherein there are no additional air chambers between the first and second air chambers.

23. The mattress of claim 18, wherein the first foam insert is positioned at a first lumbar region of the first section, the first air chamber is positioned at a first shoulder region of the first section, the second air chamber is positioned at a first hip region of the first section.

* * * * *